United States Patent [19]

Hoge

[11] 4,346,331

[45] Aug. 24, 1982

[54] FEEDBACK CONTROL SYSTEM FOR APPLYING AC POWER TO BALLASTED LAMPS

[75] Inventor: Henri H. Hoge, Baltimore, Md.

[73] Assignee: Enertron, Inc., Baltimore, Md.

[21] Appl. No.: 153,528

[22] Filed: May 27, 1980

[51] Int. Cl.[3] ..... H05B 37/02

[52] U.S. Cl. ..... 315/158; 250/214 AL; 315/156; 315/199; 315/307

[58] Field of Search ..... 315/156, 158, 194, 199, 315/291, 307, 311, DIG. 4; 250/214 AL

[56] References Cited

U.S. PATENT DOCUMENTS 3,952,242 4/1976 Ukai ..... 315/194 X 4,236,101 11/1980 Luchaco ..... 315/158

*Primary Examiner*—Eugene R. LaRoche

*Attorney, Agent, or Firm*—Oblon, Fisher, Spivak, McClelland & Maier

[57] ABSTRACT

A lighting feedback control system for applying AC power to at least one lamp, which includes a conduction angle controlled phase switching circuit connected in series with the lamp and an AC power source for switching power across the lamp, and a line switching circuit for enabling the application of AC power to the lamp through the phase switching circuit. A light sensor is provided for generating a light control signal indicative of the amount of ambient light present in the predetermined location. Coupled to the light sensing circuit is a phase angle conduction control circuit which generates and applies to a control terminal of the phase switching circuit a phase control signal to control the phase angle conduction time of the phase switching circuit based on the amount of ambient light measured by the light sensing circuit to maintain a constant level of lighting. Integrated within the phase angle conduction control circuit is an RC filter circuit which gradually increases the phase angle conduction time switching circuit from zero, or a predetermined minimum value, to a steady state phase angle conduction time based on the ambient light conditions sensed by the light sensing circuit, after power enabling by the line switching circuit.

7 Claims, 16 Drawing Figures

FEEDBACK CONTROL SYSTEM FOR APPLYING AC POWER TO BALLASTED LAMPS

BACKGROUND OF THE INVENTION

1. Field of the Invention

This invention relates to a new and improved lighting feedback control system for applying AC power from an AC power source to at least one ballasted lamp.

2. Description of the Prior Art

Various prior art circuits have addressed the problems associated with controlling the level of light illumination in a room or in a portion of a domestic or commercial building. Typically, the prior art lamp control circuits were directed to maintaining constant lamp illumination, such as for example disclosed in U.S. Pat. No. 3,609,451 to Edgerly et al. In the Edgerly et al. patent, lamp energizing power is derived from an auto transformer having a variable tap coupled to a lamp load with the positioning of the tap being controlled by a motor feedback system in accordance with the illumination sensed by a light sensor.

Another control circuit disclosed in U.S. Pat. No. 3,684,919 to Cramer is directed to a dimmer circuit for controlling the light intensity from a lamp by adjusting the firing angle of a silicon controlled rectifier (SCR) or like control element supplying AC power to the lamp. The circuit includes a firing angle function generator which produces, in sync with each AC half cycle, a signal $f(\alpha)$ monotonically related in amplitude to SCR firing angle. Comparator circuitry triggers the SCR's when the signal $f(\alpha)$ crosses the level of a light intensity control signal linearly related e.g. to dimmer control handle position. In one embodiment, the function generator includes a capacitor charged at preselected rates during portions of each AC half cycle such that the firing angle function thereby synthesized is programmable to implement any desired dimmer response.

Yet another lamp control and switching circuit is disclosed in U.S. Pat. No. 4,135,116 to Smith, in which the illumination generated by a light source is monitored, and a feedback signal generated in order to produce a gaining control signal to a switch connected in series with the light source, by which the degree of illumination produced therefrom is controlled in correspondence to the sensed output thereof.

A serious drawback of many prior art light control systems arises due to the difficulty of adjusting lighting conditions for different locations to suit the lighting requirements of each location. A further disadvantage resides in the fact that the prior art lamp control systems also generally result in the application of full power to the lamp device being controlled upon initial application of power to the lamp. However, the predominate failure mode of ballisted lamps occurs upon full application of power to a cold cathode filament, since the cold filament exhibits low resistance which produces an initial surge current upon application of full power, often destroying the lamp. Yet another problem is frequently experienced, in that typical prior art systems energize a lamp load even when ambient lighting is otherwise adequate, thereby needlessly increasing energy consumption.

U.S. Pat. No. 3,898,516 to Nakasone addresses some problems associated with cold cathode lamp firing and proposes a "soft switching" technique in which the conduction angle of a lamp switch is gradually increased following initial turn-on in accordance with the resistance of a temperature sensitive thermistor connected in circuit with the lamp.

SUMMARY OF THE INVENTION

Accordingly, one object of this invention is to provide a novel lighting feedback control system for applying an AC power signal from an AC power source to at least one lamp, wherein power to the lamp is gradually increased after initial application of power thereto, and wherein a fixed level of lighting is maintained in accordance with the total illumination present in the area being lighted.

Yet another object of this invention is to provide a novel lighting feedback control system for use in conjunction with lamps having standard ballast circuits.

A further object of this invention is to provide a novel lighting feedback control system for control of rapid start lamps or slim line lamps.

Another object of this invention is to provide a novel lighting feedback control system wherein maximum-minimum lighting illumination levels are readily selectable and adjustable.

Yet another object of this invention is to provide a novel lighting feedback control system which is energy efficient.

A further object of this invention is to provide a novel lighting feedback control system wherein complete turn-off of lamps is automatically achieved during high ambient light conditions.

Yet another object of this invention is to provide a novel lighting feedback control system which can be readily expanded for complete illumination control of large areas.

These and other objects are achieved according to the invention by providing a novel lighting feedback control system for applying AC power to at least one lamp, which includes a conduction angle controlled phase switching circuit connected in series with the lamp and an AC power source for switching power across the lamp, and a line switching circuit for enabling the application of AC power to the lamp through the phase switching circuit. A light sensor is provided for generating a light control signal indicative of the amount of ambient light present in the predetermined location. Coupled to the light sensing circuit is a phase angle conduction control circuit which generates and applies to a control terminal of the phase switching circuit a phase control signal to control the phase angle conduction time of the phase switching circuit based on the amount of ambient light measured by the light sensing circuit to maintain a constant level of lighting. Integrated within the phase angle conduction control circuit is an RC filter circuit which gradually increases the phase angle conduction time switching circuit from zero, or a predetermined minimum value, to a steady state phase angle conduction time based on the ambient light conditions sensed by the light sensing circuit, after power enabling by the line switching circuit.

The phase angle conduction control circuit of the invention is implemented by means of a sweep generating circuit for generating a ramp signal at twice the frequency and in synchronization with the AC power input to the lighting feedback control system. The ramp signal is applied to one input of a comparator, the other input of which is connected to the RC filtered output of the light sensor. Also coupled to the RC filtered output of the light sensor is a clamping circuit for maintaining the filtered RC signal within predetermined limits, thereby establishing an operating phase angle conduction range. This clamping circuit is implemented using a pair of operational amplifiers in combination with respective diodes and threshold setting circuits whereby the temperature dependence of the diodes is essentially neutralized by the open circuit gain of the operational amplifiers to derive a temperature independent clamping characteristic.

The output of the comparator of the phase angle control circuit is applied to a control pulse generating circuit which generates phase modulated control pulses for application to a control terminal of the phase angle modulated switching circuit. Also included in the control circuit is a hysteresis circuit which threshold detects the light sensor output and develops a disabling signal which prevents further generation of phase angle control pulses until the ambient light level is reduced to a predetermined level where artificial lighting is required.

In a preferred embodiment, the phase angle modulation circuit is implemented using a triac connected in series between one side of the lamp load and the AC power line, with a conventional line switch connected in series between the other side of the power supply and the other side of the lamp load.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
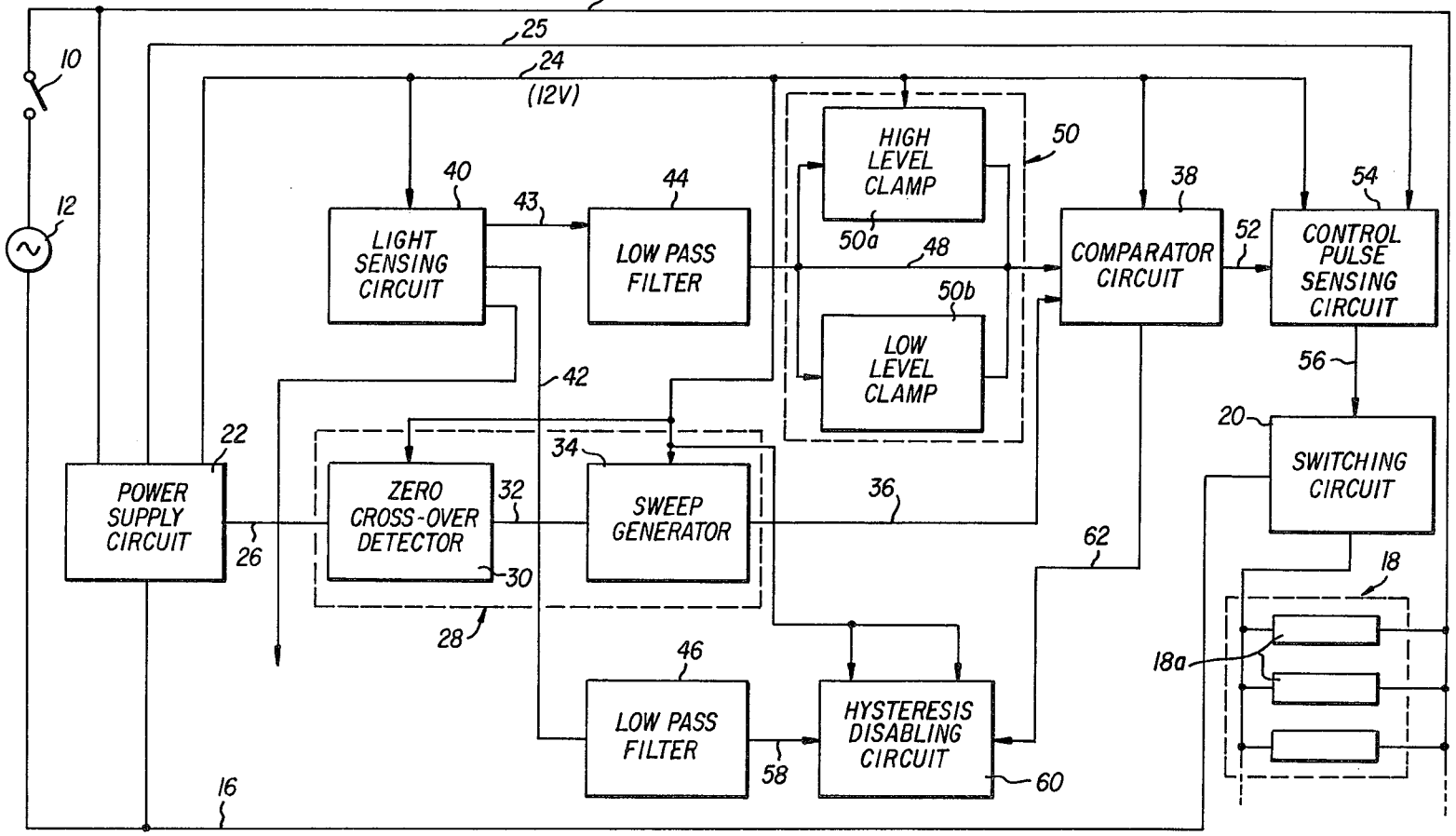
FIG. 1 is a block diagram of the lighting feedback control system according to the invention.

Referring now to the drawings, wherein like reference numerals designate identical or correspondings parts throughout the several views, and more particularly to FIG. 1 thereof, the lighting feedback control system of the invention is seen to include a line switch 10 connected in series with an AC power source 12 between a hot power line 14 and a neutral power line 16. Connected in series between the hot and neutral power lines is a lamp load 18 schematically shown as comprising plural parallel connected lamps 18*a*, and a phase angle control switching device 20. Also coupled between the hot power line 16 and the neutral power line 18 is a power supply circuit 22 which produces a regulated 12 volt output 24, an unregulated output 25, and a rectified power signal 26. The unregulated power output 25 of power supply circuit 22 is used in generation of a high current drive pulse for the switch 20, as noted hereinafter. The rectified power output 26 is applied to a ramp generating circuit 28 formed of a zero crossover detector circuit 30 having an output 32 coupled to a sweep generating circuit 34. The output 36 of sweep generating circuit 34 is in turn coupled to one input of a comparator circuit 38.

As also shown in FIG. 1, the lighting feedback control system of the invention is further formed of a light sensing circuit 40 having an output 42 coupled to a pair of low-pass filters 44 and 46. Filter 44 has an output 48 coupled to the other comparison input of the comparator 38. The output 48 of filter 44 is further applied to a clamp circuit 50 formed of a high level clamp 50*a* and a low level clamp 50*b*, each of which is coupled to the filter output 44 for maintaining the filter output 44 clamped between predetermined high and low voltage levels as described in more detail hereinafter.

Comparator 38 produces an output 52 coupled to a control pulse generating circuit 54 having an output 56 coupled to a switching control terminal of the phase angle controlled switching circuit 20.

As also shown in FIG. 1, the output 42 of light sensing circuit 40 is applied additionally to the low-pass filter 46, having an output 58 coupled to a hysteresis disabling circuit 60 having an output 62 coupled to the output 48 of the filter circuit 44.

Figure 2:
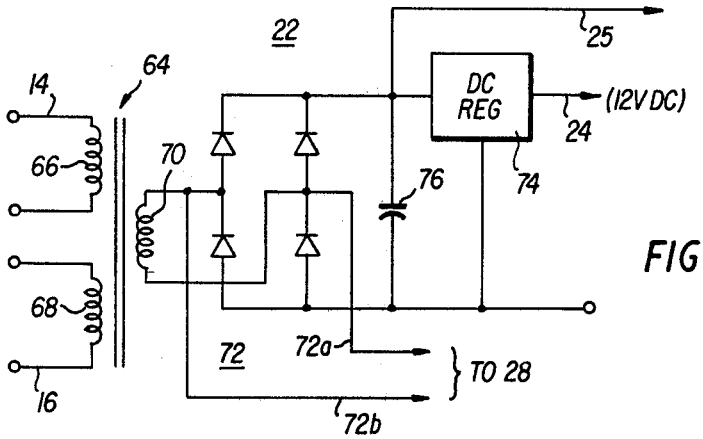
FIG. 2 is a circuit diagram of a power supply circuit shown in FIG. 1.

As shown in FIG. 2, the power supply circuit 22 is formed of a transformer 64 having a pair of primary coils 66 and 68 coupled to the power lines 14 and 16, and a secondary coil 70 coupled to a full wave rectification bridge 72. The unregulated output 75 of the bridge circuit 72 is coupled to a conventional regulating circuit 74 shunted by filtering capacitor 76 and producing the 12 volt DC regulated output signal 24. The unregulated output 25 of the power supply circuit 22 is fed to the control pulse generating circuit 54 and enables the generation of a high current drive of approximately 0.2 amps for approximately 0.5 ms used to control the switching of the switch 20, implemented by means of a conventional triac. The rectified power output 26 noted earlier is shown in FIG. 2 to be derived from the intersection of the series connected diodes conforming the bridge rectifier circuits 72.

Figure 3:
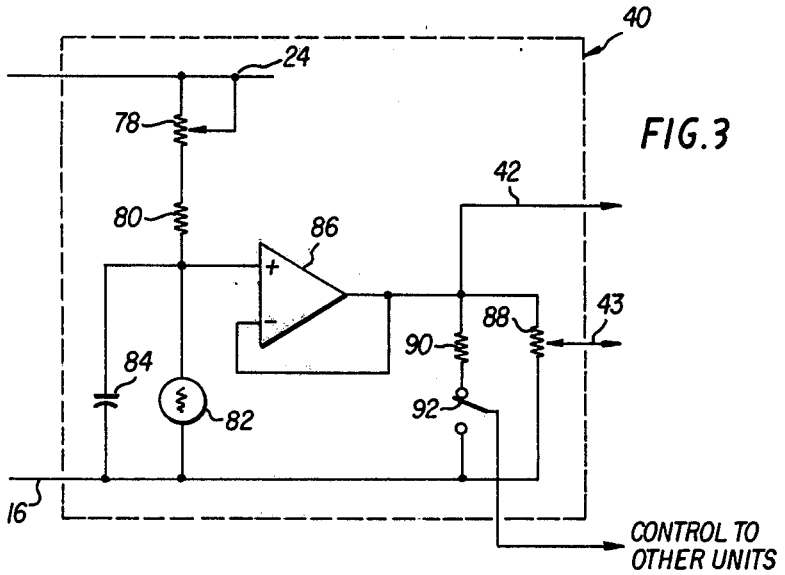
FIG. 3 is a block diagram of a light sensor circuit shown in FIG. 1.

The light sensing circuit 40, shown in more detail in FIG. 3, includes a pair of resistors 78 and 80 in series connection with a cadmium sulfide light sensing cell 82 having a resistance approximately 50 kΩ at 2 foot candles, 14 Meg Dark. Shunted across the light sensing cell 82 is a filtering capacitor 84. The junction between the resistors 80, the cell 82, and the capacitor 84 is in turn coupled to the non-inverting input of an operational amplifier 86 whose inverting input is connected to the output thereof in a voltage follower configuration. The op-amp output 42 is coupled to the low-pass filter circuit 44 as noted earlier. Connected to the output 42 of the op-amp 86 is a potentiometer 88 producing at the wiper thereof a light control signal 43 for application to the low-pass filter 44. Also coupled to the output 42 of the op-amp 86 is a resistor 90 connected to a terminal 92, which when coupled along with the neutral line 16 to a slave unit can be used as a control signal to control the conduction phase angle of a switching circuit 20 of the slave unit. Thus, the feedback control system of the invention is readily expandable by connecting the terminals 94, 16 of one unit to the terminals 94, 16 of another unit.

Figure 8A:
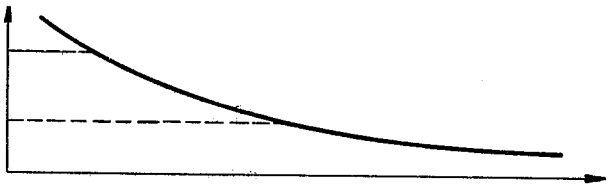
FIGS. 8*a*–8*i* are illustrations of various waveforms existing in the circuits shown in FIGS. 1–7.

As shown in FIG. 8*a*, the light sensitive cell 82 exhibits a linear resistance versus incident light characteristic, with the resistance of the cell 82 decreasing with increasing incident light. In fact, in a preferred embodiment, a selected cadmium sulfide cell over a range of incident light varying from 0.2 to 10 foot candles undergoes a linear decrease in resistance by a factor of 2 for every increase of incident light by a factor of 2. Resistors 78 and 80 establish a current through the cadmium sulfide photocell and thereby selectively establish the operating range thereof.

Figure 4:
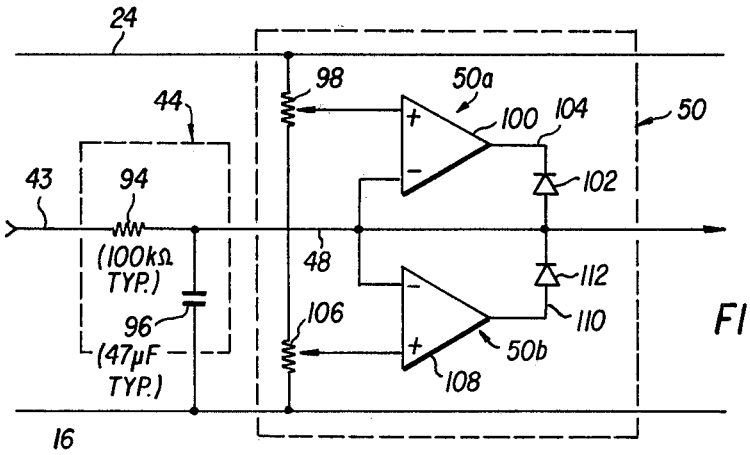
FIG. 4 is a circuit diagram of a clamping circuit shown in FIG. 1.

As shown in FIG. 4, the output 43 in the light sensing circuit 40 is coupled to the low-pass filter 44 formed of a series combination of a resistor 94 in a capacitor 96. The filter output 48 at the junction between the resistor 94 and capacitor 96 is coupled through the clamping circuit 50 to the comparator 38. Clamping circuit 50 includes the high-level clamping portion 50*a* formed by high level setting potentiometer 98 having a wiper coupled to the non-inverting input of operational amplifier 100. The inverting input of amplifier 100 in turn is connected to the filter output 48 in the anode of diode 102 whose cathode is in turn connected to the output 104 of the op-amp 100. The clamp 50 further includes the low level clamping circuit 50*b* similarly formed of a low level threshold setting potentiometer 106 having a wiper connected to the non-inverting input of op-amp 108 whose inverting input is connected to the filter output 48 and whose output 110 is connected to the filter output 48 via diode 112.

The dual clamping circuit 50 above described is used to restrict the voltage swing at the output 48 of the filter circuit 44. Op-amps 100 and 108 in effect serve as dual comparators where a comparison between the filter output 48 and the threshold levels established by potentiometers 98 and 106 is continuously monitored. In this way, the feedback control circuit of the invention establishes a lighting control operating range while uniquely eliminating the usual diode threshold voltage/temperature characteristic by a factor of the open loop gain of the respective op-amps 100 and 108 in order to insulate the operating range of the system of the invention from temperature variations.

As an example of the operation of the clamping circuit 50, if the filter output voltage 48 increases to where it hypothetically exceeds the wiper voltage of potentiometer 100 by 2 mv, the output 104 of op-amp 100 switches negative in order to pull the anode of diode 102 to less than 2 mv. In this way, should the diode threshold decrease with temperature, the filter output voltage 48 remains essentially unaffected by the diode voltage/temperature shift, by a factor of approximately the open loop gain of the op-amp 100. Op-amp 108 operates in a similar manner except that the op-amp 108 switches positive in order to keep the filter output voltage 48 within approximately 1 mv of the voltage appearing at the wiper of potentiometer 106.

Figure 5:
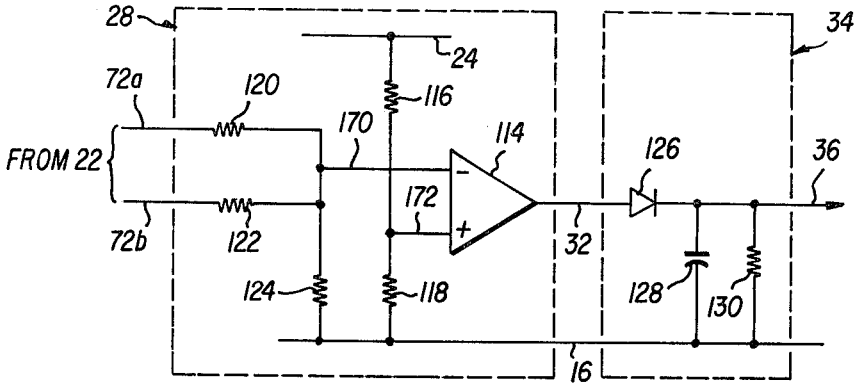
FIG. 5 is a circuit diagram of a sweep generating circuit shown in FIG. 1.

The ramp generating circuit shown in FIG. 5 includes a zero crossover detector 30 formed of an operational amplifier 114 having a non-inverting input connected to a threshold setting junction provided by the series connection of resistors 116 and 118, and an inverting input coupled to a junction between resistors 120, 122 and 124. Resistors 120 and 122 having the other sides thereof connected to respective series connection points of the diode bridge 24 such that a full wave rectified, voltage divided power supply signal is applied to the inverting input of the op-amp 114. Also, since resistor 116 is considerably larger than resistor 118, the non-inverting input to the op-amp 114 is set at a level slightly above the neutral bus bar.

Coupled to the output of op-amp 114 is an integrating circuit formed by diode 126, the anode of which is connected to the output of the op-amp 114, and which has a cathode connected to the parallel combination of capacitor 128 and resistor 130.

Figure 8B:
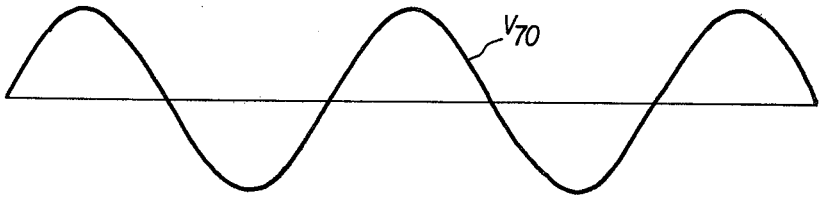
Figure 8C:
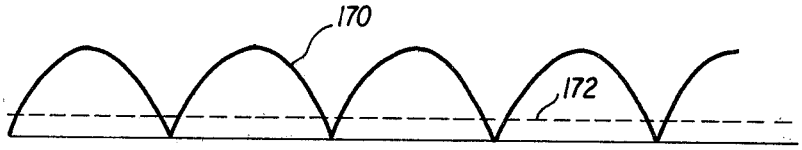
Figure 8D:
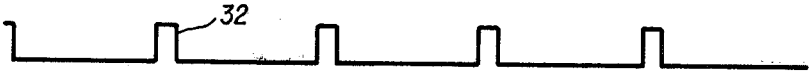
Figure 8E:
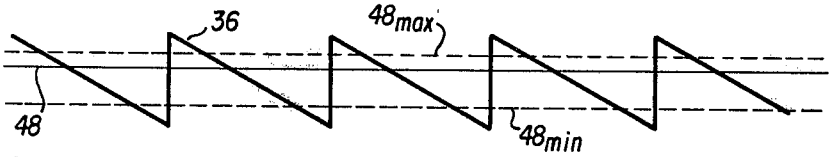
Figure 8F:
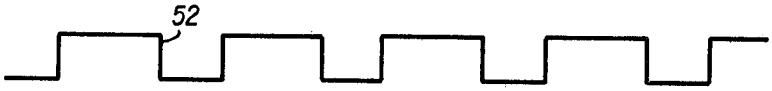

FIGS. 8*b*–8*e* illustrate the operation of the ramp generating circuit. In FIG. 8*b* is shown the waveform existing across the secondary 70 of transformer 64, whereas in FIG. 8*c* the rectified and voltage divided signal applied to the inverting input of op-amp 114 is shown as waveform 170, while the threshold level generated by resistors 116 and 118 as applied to the non-inverting input of the op-amp 114 is shown as the waveform 172. In FIG. 8*d* is illustrated the output of the op-amp 114, and it is seen that whenever the rectified voltage, at the inverting input of the op-amp 114 drops below the threshold applied to the non-inverting input thereof, the op-amp 114 generates a pulse signal 132 shown in FIG. 8*d*. The pulse output of the op-amp applied to diode 126 results in rapid charging of capacitor 128 as shown in FIG. 8*e*. Thereafter, when the level of the inverting input to the op-amp 114 exceeds the non-inverting input thereto, the op-amp switches state, which reverse biases diode 126, causing capacitor 128 to discharge through resistor 130 at a predetermined time constant to produce the ramp signal 36 shown in FIG. 8*e*.

Figure 6:
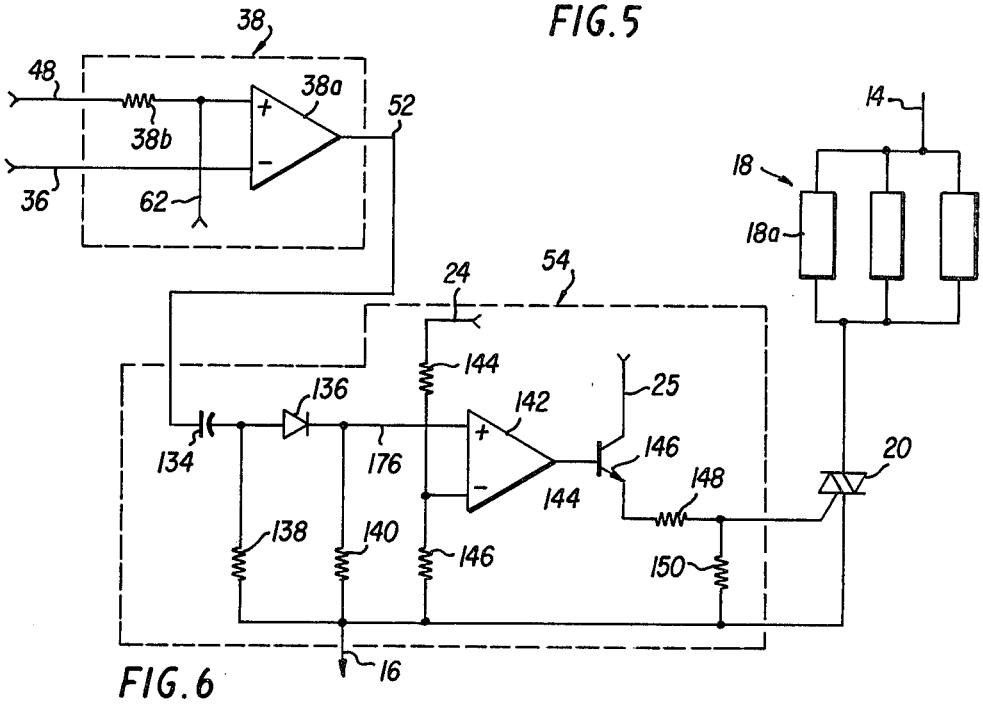
FIG. 6 is a circuit diagram of a phase modulation pulse producing circuit shown in FIG. 1.

As noted earlier, the ramp signal 36 is applied to one input of the comparator 38 as shown in more detail in FIG. 6. The other input to the comparator is the filtered light sensor signal 48 above described, and illustrated for explanation purposes in FIG. 8*e*. It is seen in FIG. 8*e* that the signal 48 can vary between a maximum level $48_{max}$ in the absence of any illumination sensed by the light sensing circuit 40 to a minimum level $48_{min}$ corresponding to a high degree of illumination. As shown in FIG. 8*e*, each time the ramp signal 36 exceeds the filtered light sensor signal 48, the output 52 of comparator 50 is low, whereas when the filtered light sensor signal 48 exceeds the level of the ramp signal 36, the output signal 52 of comparator 50 is at a high logic level.

FIG. 6 illustrates the control pulse generating circuit 54, and its interconnection with the comparator circuit 38 and the phase control switching device 20. Circuit 54 is thus seen to include a differentiating circuit formed of capacitor 134 connected in series between the output of the comparator circuit 38 and the anode of diode 136, resistors 138 and 140 being respectively connected between the anode and cathode of diode 136 and the neutral power line. The cathode of diode 136 is coupled to the non-inverting input of op-amp 142, the inverting input of which is coupled to a threshold setting resistor divider network formed by resistors 144 and 146. The output 144 of op-amp 142 is applied to the base of NPN transistor 146, the collector of which is connected to the unregulated power supply output 25. The emitter of transistor 146 is coupled to a voltage divider formed by resistors 148 and 150, the junction between these resistors being connected to the gate input of the phase angle controlled switching device, which in the preferred embodiment shown in FIG. 6 is implemented by means of a conventional triac.

Figure 8G:
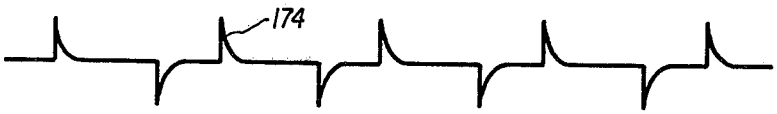
Figure 8H:
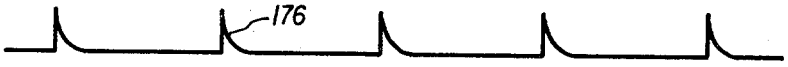
Figure 8I:
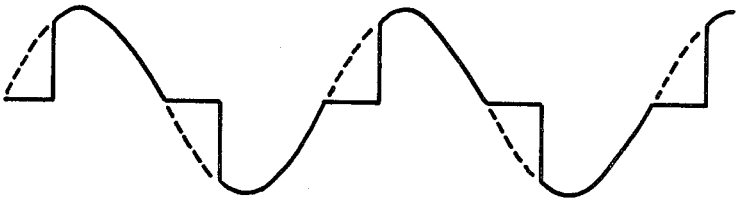

Operation of the control pulse generating circuit 54 is now explained by reference to FIGS. 8*g*–8*i*. FIG. 8*g* illustrates the signal 174 occurring at the anode of diode 136, which signal includes negative going spikes for each negative going edge of the output of the comparator 38, and positive going spikes for each rising edge of the comparator output. Diode 136 serves to block the negative going spikes such that only the positive going spikes 176, which occur at the point where the filtered light sensor signal 48 intersects the ramp signal 36, as shown in FIG. 8*e*, are applied to the non-inverting input of op-amp 142. Since the voltage divided level at the inverting input of op-amp 142 is selected so as to be below the peak amplitude of the positive going spikes shown in FIG. 8*g*, op-amp 142 is switched positive for each positive going spike, as shown in FIG. 8*h*. Signal 144 renders the transistor 146 conductive, producing a high current drive pulse for the system power triac having an amplitude of approximately 0.2 amps for a time period of approximately 0.5 ms. As shown in FIG. 8*i*, therefore, triac conduction is commenced upon the occurrence of each positive going pulse signal 144, while current conduction ceases in the triac upon a phase reversal of the line voltage.

As indicated above, FIG. 8*i* is illustrative of the current conduction angle of the triac switch. More accurately, however, the broken line waveform shown in FIG. 8*i* illustrates the line voltage, while the solid line waveform shown in FIG. 8*i* illustrates the voltage across the lamp load. Since the leading edge of the lamp drive waveform is variable and dependent upon the amount of light detected by the light sensing circuit 40, as derived from the intersection of the filtered light sensor output 48 with the ramp signal 36 as shown in FIG. 8*e*, a steady state control range is achieved. The maximum phase conduction angle corresponding to a minimal ambient light reading is established by the high level clamp 50*b*, whereas the minimum phase conduction angle within the control range, corresponding to a high ambient light condition is established by the low level clamp 50*b* and the threshold there defined. In a preferred embodiment, a conduction range varying between 25° and 86° (electrical) of the line waveform has provided excellent results although this control range is easily adjustable by variation of the clamping thresholds established in the clamping circuit 50.

Figure 7:
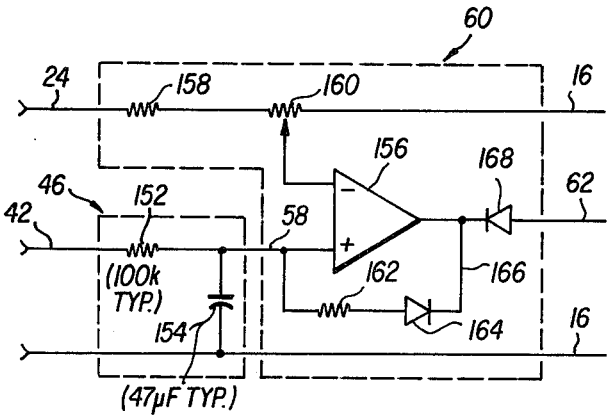
FIG. 7 is a circuit diagram of a hysteresis circuit shown in FIG. 1.

An energy saving feature of the feedback control system of the invention resides in the ability to disenable the production of control pulses to the triac gating terminal in the event that the light sensor circuit 40 senses a high ambient-like condition not requiring artificial illumination. For that purpose the hysteresis disabling circuit 60 shown in FIG. 7 is provided. The hysteresis disabling circuit 60 includes the low pass filter circuit 46 formed by the series combination of resistor 152 and capacitor 154, with one side of the resistor 152 being coupled to the output 42 of the light sensor circuit 40. The other side of the resistor 152 is coupled to the non-inverting input of an operational amplifier 156 serving as a comparator. The inverting input of the comparator is connected to a voltage divider circuit formed by resistor 158 connected in series with potentiometer 160, the wiper of which is connected to the inverting input of the op-amp 156. Also, the non-inverting input of the op-amp 156 is connected through the series combination of a resistor 162 connected to the anode of diode 164, the cathode of which is connected to the output 166 of the op-amp 156. The output 166 is connected to the cathode of diode 168, the anode of which produces the disabling signal 62 shown in FIG. 6 being applied to the comparator circuit 38. The output 62 is connected to the non-inverting input of the comparator op-amp 38*a* and also to one side of resistor 38*b*, the other side of which has applied thereto the filtered light sensor circuit output 48 as hereinabove described.

During operation, the light sensor output circuit 42 is filtered by the combination of resistor 152 and capacitor 154 and compared against the threshold established by resistor 158 and potentiometer 160 by means of the op-amp 156. If it is assumed that the signal 42 is at a higher level than the signal for wiper of potentiometer 160, then the op-amp output 166 is at a high level, back biasing the diode 164 and removing the resistance of 162 from the circuit. If, however, the signal 42 is at a lower level than the threshold level established at the wiper of potentiometer 160, then the op-amp switches to the low state, diode 164 becomes conducting, and resistor 162 is then effectively connected across the op-amp 156 from the non-inverting input to the output thereof. In this instance, resistors 152 and 162 essentially form a voltage divider circuit such that the non-inverting input of the op-amp 156 experiences a decrease in level in dependence on the relative values of the resistors 152 and 162. Thus, in order for the op-amp 156 to once again switch to a high level output state, it is necessary that the signal 42 increases to a level determined by the values of resistance of resistors 152 and 162 above the threshold set at the inverting op-amp input. For example, if resistors 152 and 162 have the same value, then it will be necessary for the light sensor circuit output 42 to double after switching of the op-amp to a low output state before the op-amp 156 returns to the high level output state. In this way, the disabling circuit for the invention is provided with a hysteresis characteristic in order to avoid objectionable light flickering.

As noted above, the output 62 at the anode of diode 168 is applied to the comparator circuit 38. When the light sensor circuit output 42 drops below the threshold established at the wiper of the potentiometer 160, the output 166 of op-amp 156 is switched to a low level, forward biasing the diode 168 and effectively pulling the non-inverting input of comparator op-amp 38*a* shown in FIG. 6 to the low level output of the hysteresis disabling op-amp 156 shown in FIG. 7. When this occurs, the signal 62 is continuously below the level of the ramp signal 36 shown in FIG. 8*e*, since the ramp signal 36, the minimum level of which is determined by the time constant established by resistor 130 and capacitor 128, is designed to have a minimal level above the disabling level of the output 62. In this way, once the output 62 is switched to the low level, the comparator 38*a* of circuit 38 is prevented from switching to a high level, thereby preventing the further production of phase conduction control pulses to the triac switch 20.

An important feature of the invention resides in the "soft switching" capability provided by the filter circuit 44, whereby upon closing of the line switch 10, power is gradually applied to the lamp load by gradually increasing the phase conduction time of the triac switch 20. Also playing a role in the "soft switching" feature is the hysteresis disabling circuit 60, as is now described.

Upon closing of the switch 10, regulated 12 volt power is relatively quickly generated and applied to the circuits of the feedback control system of the invention. However, at that time both capacitors 128 and 154 of the filter circuits 44 and 46 are totally discharged, such that not only is the filtered light sensor signal 48 at a level below the clamping level established by low level clamp 50*b*, but also the hysteresis op-amp 156 has a low output 166 until the capacitor 154 charges above the threshold level established at the wiper of potentiometer 160. In this way, the hysteresis disabling circuit delays charging of the capacitor 128 of filter 44 until charging of the capacitor 154 whereupon the disabling output 62 changes to the high logic level. At this point, capacitor 128 gradually charges from zero to the level of output 43 from the light sensor circuit 40, and eventually exceeds the minimum level of the ramp signal 36 produced by the ramp generating circuit 28. At this point, the production of phase angle control conduction pulses by the generating circuit 54 ensues, with the conduction period gradually increasing as the charging voltage across capacitor 128 gradually increases to a steady state level. It should, however, be understood that the initial conduction angle occurring at the closing of switch 10 is smaller than the smallest steady state control range conduction angle established by the clamping circuit 50, and can be selected to begin at approximately 0° (electrical) by merely selecting the component values such that the lowest level of the ramp 36 is essentially near the level of the neutral power line.

Briefly recapitulating, the lighting feedback control system of the invention provides a predetermined amount of illumination in a given area by controlling the phase conduction angle of a solid state switching device in correspondence to the sensed illumination in the area. Incorporated within the control system are specific measures to ensure that line power is gradually applied to the lamp load, resulting in "soft switching" of the lamp load and thereby increasing the effective service life thereof. The control system is useful in conjunction with various types of loads, and in particular ballasted lamps, including rapid start lamps or slim line lamps. Furthermore, control limits established by the system of the invention are entirely adjustable, and easily vary to suit the psychological demands of a particular user in a particular location.

Obviously, numerous modifications and variations of the present invention are possible in light of the above teachings. It is therefore to be understood that within the scope of the appended Claims, the invention may be practiced otherwise than as specifically described herein.

What is claimed as new and desired to be secured by Letters Patent of the United States is:

1. A lighting feedback control system for applying an AC power signal from an AC power source to at least one lamp, comprising:

phase switching means connected in series with said lamp and said AC power source for switching power across said lamp, said phase switching means comprising a control terminal for switching said phase switching means to a low impedance state upon application of a phase control signal thereto;

line switching means for enabling the application of AC power to said lamp through said phase switching means;

light sensing means for generating a light control signal indicative of an amount of light present in a predetermined location;

phase angle conduction control means having an input coupled to said light control signal for generating and applying said phase control signal to said control terminal of said phase switching means, said phase angle control means controlling the phase angle conduction time of said phase switching means based on the amount of light measured by said light sensing means to maintain a constant level of lighting, said phase angle control means comprising, filter means for increasing the phase angle conduction time of said phase switching means from a predetermined minimum value to a steady state phase angle conduction time based on said light control signal after power enabling by said line switching means;

wherein said phase angle conduction control means comprises output disabling means coupled to said light sensing means for disabling the switching of said phase switching means when said light control signal has a first level indicative of a first predetermined amount of light, comprising hysteresis circuit means for maintaining disabled the switching of said phase switching means after said light control signal has said first level until said light control signal has a second level indicative of a second predetermined amount of light.

2. A lighting feedback control system according to claim 1, wherein said phase angle control means further comprises:

sweep generating means for generating a ramp signal at twice the frequency and in synchronization with said AC power signal, said filter means comprising a low pass filter having an input coupled to said light control signal and producing a filtered light control signal at an output thereof, first comparator means having said ramp signal and said filtered light control signal as inputs for producing a gating pulse signal each time the level of said ramp signal drops below the level of said filtered first control signal, said gating pulse signal applied to the phase control terminal of said phase switching means.

3. A system according to claim 1 wherein said line switching means comprises:

a line switch connected in series between said AC source and one side of said lamp, said phase switching means connected in series between the other side of said lamp and said AC power source.

4. A system according to claim 2, wherein said phase control means further comprises:

level clamping means coupled to said filter means for clamping the filtered light control signal to said first comparator means between first and second control levels.

5. A system according to claim 4, wherein said level clamping means comprises:

first and second operational amplifiers each having an inverting input connected to said filtered light control signal, first level setting means coupled to a non-inverting input of said first operational amplifier for setting a maximum level for said filtered light control signal, second level setting means coupled to a non-inverting input of said second operational amplifier for setting a minimum level for said filtered light control signal;

a first diode having an anode connected to the output of said first operational amplifier and a cathode coupled to said filtered light control signal, and a second diode having a cathode connected to the output of said second operational amplifier and an anode coupled to said filtered light control signal.

6. A system according to claim 1, wherein said phase switching means comprises:

a triac.

7. A lighting feedback control system for applying an AC power signal from an AC power source to at least one lamp, comprising:

phase switching means connected in series with said lamp and said AC power source for switching power across said lamp, said phase switching means comprising a control terminal for switching said phase switching means to a low impedance state upon application of a phase control signal thereto;

line switching means for enabling the application of AC power to said lamp through said phase switching means;

light sensing means for generating a light control signal indicative of an amount of light present in a predetermined location;

phase angle conduction control means having an input coupled to said light control signal for generating and applying said phase control signal to said control terminal of said phase switching means, said phase angle control means controlling the phase angle conduction time of said phase switching means based on the amount of light measured by said light sensing means to maintain a constant level of lighting, said phase angle control means comprising, filter means for increasing the phase angle conduction time of said phase switching means from a predetermined minimum value to a steady state phase angle conduction time based on said light control signal after power enabling by said line switching means;

wherein said phase angle control means further comprises:

sweep generating means for generating a ramp signal at twice the frequency and in synchronization with said AC power signal, said filter means comprising a low pass filter having an input coupled to said light control signal and producing a filtered light control signal at an output thereof, first comparator means having said ramp signal and said filtered light control signal as inputs for producing a gating pulse signal each time the level of said ramp signal drops below the level of said filtered first control signal, said gating pulse signal applied to the phase control terminal of said phase switching means, level clamping means coupled to said filter means for clamping the filtered light control signal to said first comparator means between first and second control levels, including first and second operational amplifiers each having an inverting input connected to said filtered light control signal, first level setting means coupled to a non-inverting input of said first operational amplifier for setting a maximum level for said filtered light control signal, second level setting means coupled to a non-inverting input of said second operational amplifier for setting a minimum level for said filtered light control signal;

a first diode having an anode connected to the output of said first operational amplifier and a cathode coupled to said filtered light control signal, and a second diode having a cathode connected to the output of said second operational amplifier and an anode coupled to said filtered light control signal.

* * * * *